US010994165B2

(12) United States Patent
Parent

(10) Patent No.: US 10,994,165 B2
(45) Date of Patent: May 4, 2021

(54) PORTABLE PARALLETTES

(71) Applicant: James Parent, Mount Pleasant, MI (US)

(72) Inventor: James Parent, Mount Pleasant, MI (US)

( * ) Notice: Subject to any disclaimer, the term of this patent is extended or adjusted under 35 U.S.C. 154(b) by 60 days.

(21) Appl. No.: 16/520,932

(22) Filed: Jul. 24, 2019

(65) Prior Publication Data

US 2020/0030652 A1 Jan. 30, 2020

Related U.S. Application Data

(60) Provisional application No. 62/702,606, filed on Jul. 24, 2018.

(51) Int. Cl.
*A63B 3/00* (2006.01)
*A63B 23/12* (2006.01)

(52) U.S. Cl.
CPC ..... *A63B 3/00* (2013.01); *A63B 23/1227* (2013.01); *A63B 2210/50* (2013.01); *A63B 2225/09* (2013.01)

(58) Field of Classification Search
CPC ... A63B 3/00; A63B 2225/09; A63B 23/1227; A63B 2210/50; A63B 1/00; A63B 4/00; A63B 9/00; A63B 21/0004; A63B 21/00047–00054; A63B 21/00178; A63B 21/06–0601; A63B 21/0607; A63B 21/0609; A63B 21/068; A63B 21/072–075; A63B 2023/006; A63B 23/12–1236; A63B 23/14; A63B 26/003; A63B 2210/00; A63B 2210/58
USPC ..... 248/346.3
See application file for complete search history.

(56) References Cited

U.S. PATENT DOCUMENTS

| | | | | |
|---|---|---|---|---|
| 4,105,201 A * | 8/1978 | L'Ecuyer | A63B 4/00 482/34 |
| 5,720,697 A * | 2/1998 | Winkel | A63B 3/00 434/255 |
| 10,252,095 B1 * | 4/2019 | Carnahan | A63B 71/023 |
| 2012/0040811 A1 * | 2/2012 | DeTore | A63B 21/00047 482/141 |
| 2019/0269957 A1 * | 9/2019 | Petrucci | A47B 81/00 |

* cited by examiner

*Primary Examiner* — Jennifer Robertson
*Assistant Examiner* — Catrina A Letterman
(74) *Attorney, Agent, or Firm* — Dale J. Ream

(57) ABSTRACT

A parallettes apparatus is portable and configured to allow an athlete to exercise even when remote from a traditional gymnastics training facility. The portable parallettes apparatus includes a pair of base members and a bar member removably extending between respective base members. The pair of base members are hollow and configured to receive the bar during transport or storage.

16 Claims, 5 Drawing Sheets

PORTABLE PARALLETTES

REFERENCE TO RELATED APPLICATIONS

This application claims the benefit of provisional patent application U.S. Ser. No. 62/702,606 filed Jul. 24, 2018 titled Portable Parallettes and which is incorporated herein by reference.

BACKGROUND OF THE INVENTION

The present invention relates generally to gymnastics exercise devices and, more particularly, to a parallettes apparatus that is portable and configured to allow an athlete to exercise even when remote from a traditional gymnastics training facility.

Students and participants in gymnastics and dance often exercise using parallel bars that enable the execution of handstands, pirouettes, and the like. Devices having a pair of parallel bars for carrying out these exercises are typically found in a gym or training facility due to their size and expense. However, the sports of gymnastics and dance are becoming mobile and students have a desire to train around the clock and while offsite, such as while at home. The young ages of many of these athletes make it even more desirable to be able to train at home, while on vacation, or really anytime and anywhere.

Therefore, it would be desirable to have a parallettes apparatus that is portable and can be transported easily in a sports bag, back pack, luggage, or even in the packaging from which the apparatus is purchased. Further, it would be desirable to have a parallettes apparatus that is modular—having a first base member, a second base member, and a bar removably extending between respective base members.

SUMMARY OF THE INVENTION

A parallette apparatus according to the present invention includes a first base member having a plurality of first walls that form a rectangular tubular configuration and that collectively define a first interior area. Similarly, the parallette apparatus includes a second base member having a plurality of second walls that form, collectively, a rectangular tubular configuration and that collectively define a second interior area. A bar includes a linear and elongate configuration and has a bar first end removably coupled to a first top wall of said first base member and a bar second end removably coupled to a second top wall of said second base member. The bar includes a body section displaced from said bar first end and displaced from said bar second end, said body section having a cylindrical shape configuration.

Therefore, a general object of this invention is to provide a parallettes apparatus that is portable and configured to allow an athlete to exercise even when remote from a traditional gymnastics training facility.

Another object of this invention is to provide a parallettes apparatus that is modular and includes a pair of base members and a bar extending therebetween that may be separated for being stowed or transported in a small amount of space and then reassembled quickly for use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
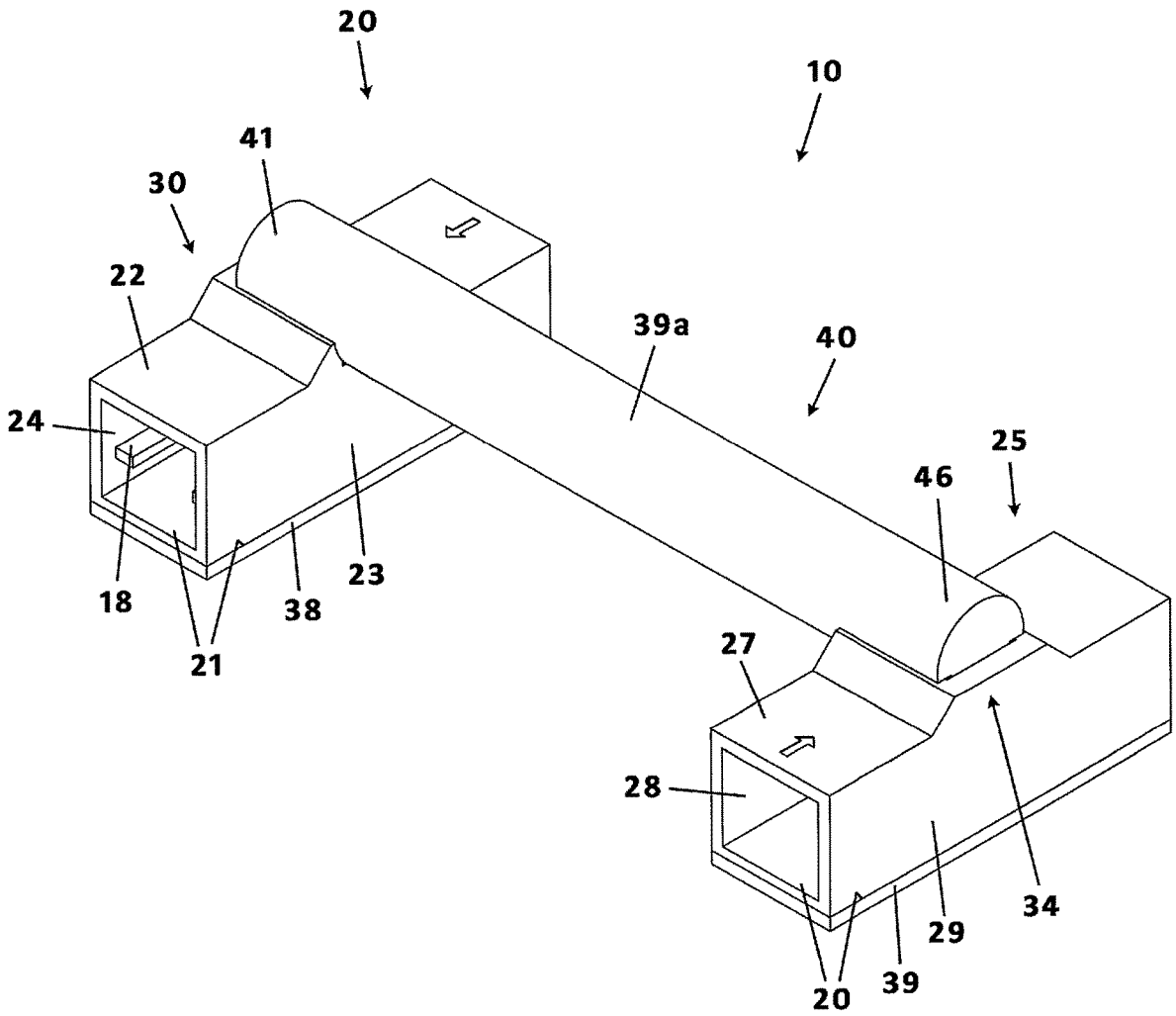
FIG. 1 is a perspective view of a parallette apparatus according to a embodiment of the present invention.

A portable parallettes apparatus according to a preferred embodiment of the present invention will now be described with reference to FIGS. 1 to 7 of the accompanying drawings. The portable parallettes apparatus 10 includes a pair of base members 20, 25 and a bar member 40 removably extending between respective base members. It will be appreciated that a pair of parallette apparatus 10 are intended for use by a user, namely, one parallette apparatus for each hand of the user. Each unit of the portable parallette apparatus 10 consists of three components which work together to create the parallette apparatus 10 which can be used for exercises. The parallette apparatus 10 consists of a first base member 20, a second base member 25 which are identical in nature, as well as a bar member 40 (which may also be referred to merely as a bar) removably extending between respective base members.

More particularly, a first base member 20 includes a plurality of first walls arranged in the form of a rectangular and tubular housing that is hollow, such as a square tube, or sometimes referred to square metal tubing. More particularly, the first base member 20 may include a first bottom wall 21 and a first top wall 22 opposite and parallel to the first bottom wall 21 and that includes a first inside wall 23 and a first outside wall 24 opposed to the first inside wall 23. The first inside wall 23 and first outside wall 24 extend between the first top wall 22 and the first bottom wall 21, respectively. Further, the first base member 20 defines opposed open ends through which the hollow or first interior area is accessed. For clarity, the open ends of the first base member may be referred to as first and second open ends. Having an identical construction, the second base member 25 may include a second bottom wall 26 and a second top wall 27 opposite and parallel to the second bottom wall 26 and that includes a second inside wall 28 and a second outside wall 29 opposed to the second inside wall 28. The second inside wall 28 and second outside wall 29 extend between the second top wall 27 and the second bottom wall 26, respectively. Further, the second base member 25 defines opposed open ends through which the hollow or second interior area is accessed. For clarity, the open ends of the second base members may be referred to as third and fourth open ends. As will be discussed later, the inner surface of each base member and a respective open end has a configuration complementary to and operable to receive a respective bar member 40 therein for transport and storage.

Figure 2:
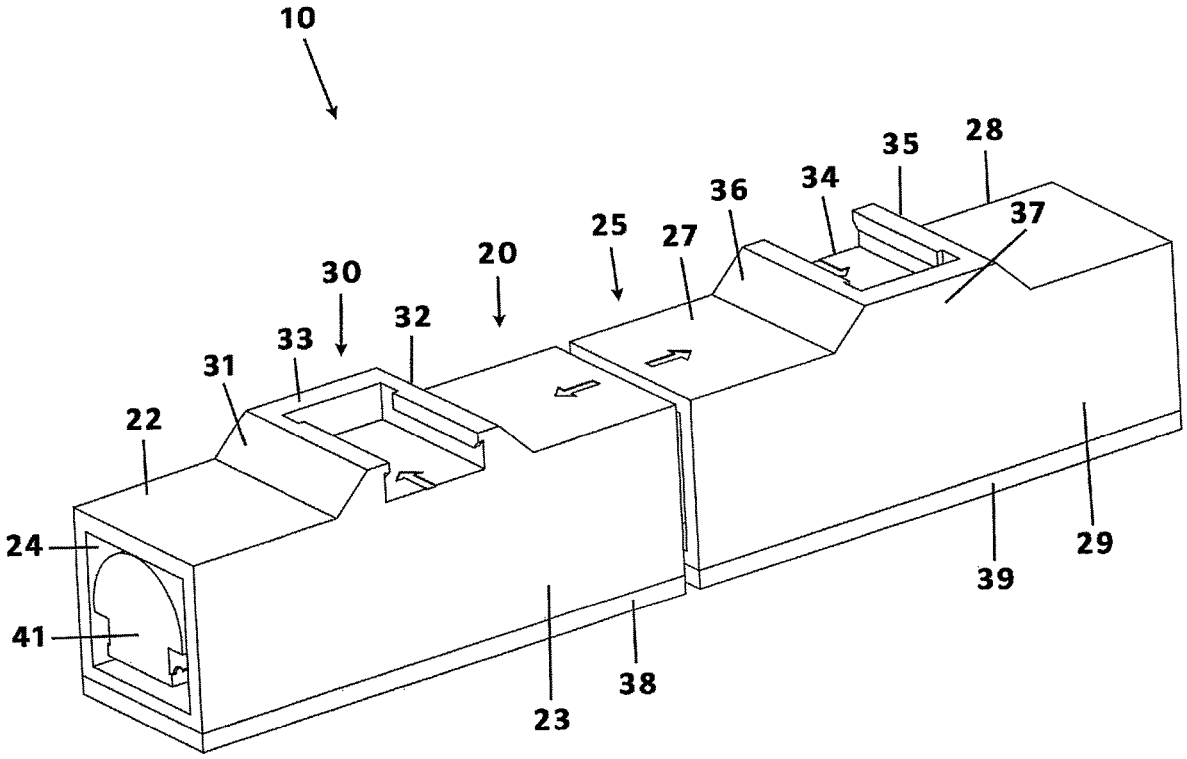
FIG. 2 is a perspective view of a pair of base members of the parallette apparatus as in FIG. 1, illustrated situated side by side for clarity.
Figure 3:
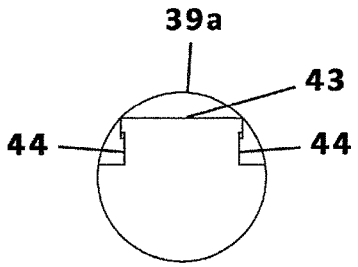
FIG. 3 is an end view of a bar member removed from the parallette apparatus as in FIG. 1.

Atop each base member is a nesting portion configured to receive a respective end of the bar member 40 as will be described below in more detail. More particularly, a first nesting portion 30 is situated atop the first base member 20 and may be constructed and attached or may have an integrated or singular construction with the first base member 20. The first nesting portion 30 may include three upstanding walls that, together, define an open side that allows and guides the first end 41 of the bar member 40 into an open space of the first nesting portion 30 (FIG. 2). Even more particularly, the first nesting portion 30 may include a first upstanding side wall 31, a second upstanding side wall 32 opposite, displaced, and parallel to the first upstanding side wall 31, and an outer side wall 33 extending between outer edges of the first and second upstanding side walls, respectively, of the first nesting portion 30. Accordingly, the inner edges of the first and second upstanding side walls define an open area or void that is configured to receive the first end 41 of the bar member 40 into the first nesting portion 30. Further, the first and second upstanding side walls of the first nesting portion 30 may include inwardly extending ledges (unlabeled) configured to mate with the side walls 44 of the first end 41 of the bar member 40, respectively, in a friction fit relationship. Having a construction that is identical or substantially similar, a second nesting portion 34 is situated atop the second base member 25 and may be constructed and attached to or may have an integrated or singular construction with the first base member 20. The second nesting portion 34 may include three upstanding walls that, together, define an open side that allows and guides the first end 41 of the bar member 40 into an open space of the second nesting portion 34 (FIG. 2). Even more particularly, the second nesting portion 34 may include a first upstanding side wall 35, a second upstanding side wall 36 opposite, displaced, and parallel to the first upstanding side wall 35, and an outer side wall 37 extending between outer edges of the first and second upstanding side walls, respectively, of the second nesting portion 34. Accordingly, the inner edges of the first and second upstanding side walls of the second nesting portion 34 define an open area or void that is configured to receive the second end 46 of the bar member 40 into the second nesting portion 34. Further, the first and second upstanding side walls of the second nesting portion 34 may include inwardly extending ledges (unlabeled) configured to mate with the side walls 44 of the first end 41 of the bar member 40, respectively, in a friction fit relationship.

The base members 20, 25 may be a molded plastic hollow square tube with a molded PPR rubber material applied to the bottom which forms an anti-slip surface. Each anti-slip surface may be referred to as a first anti-slip layer 38 and a second anti-slip layer 39.

Figure 4:
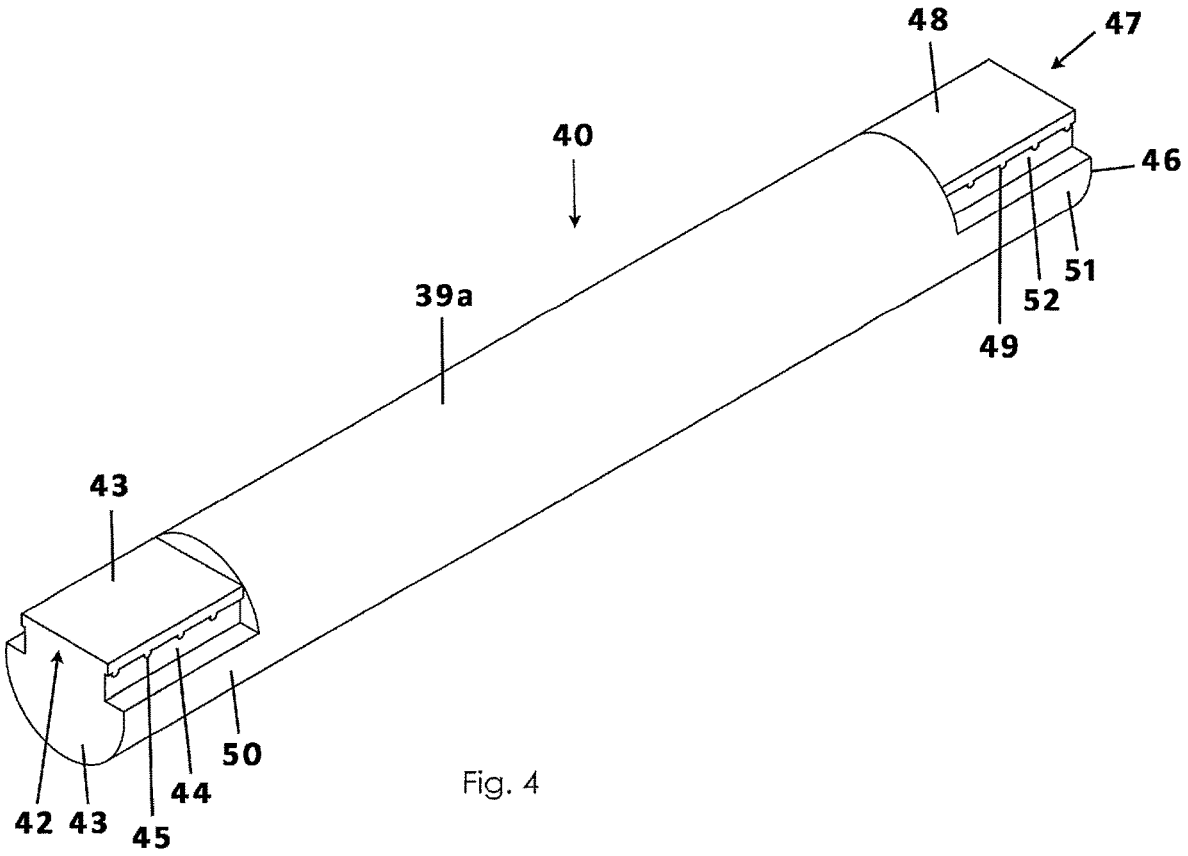
FIG. 4 is a perspective view of the bar member removed from the parallette apparatus as in FIG. 1.
Figure 5:
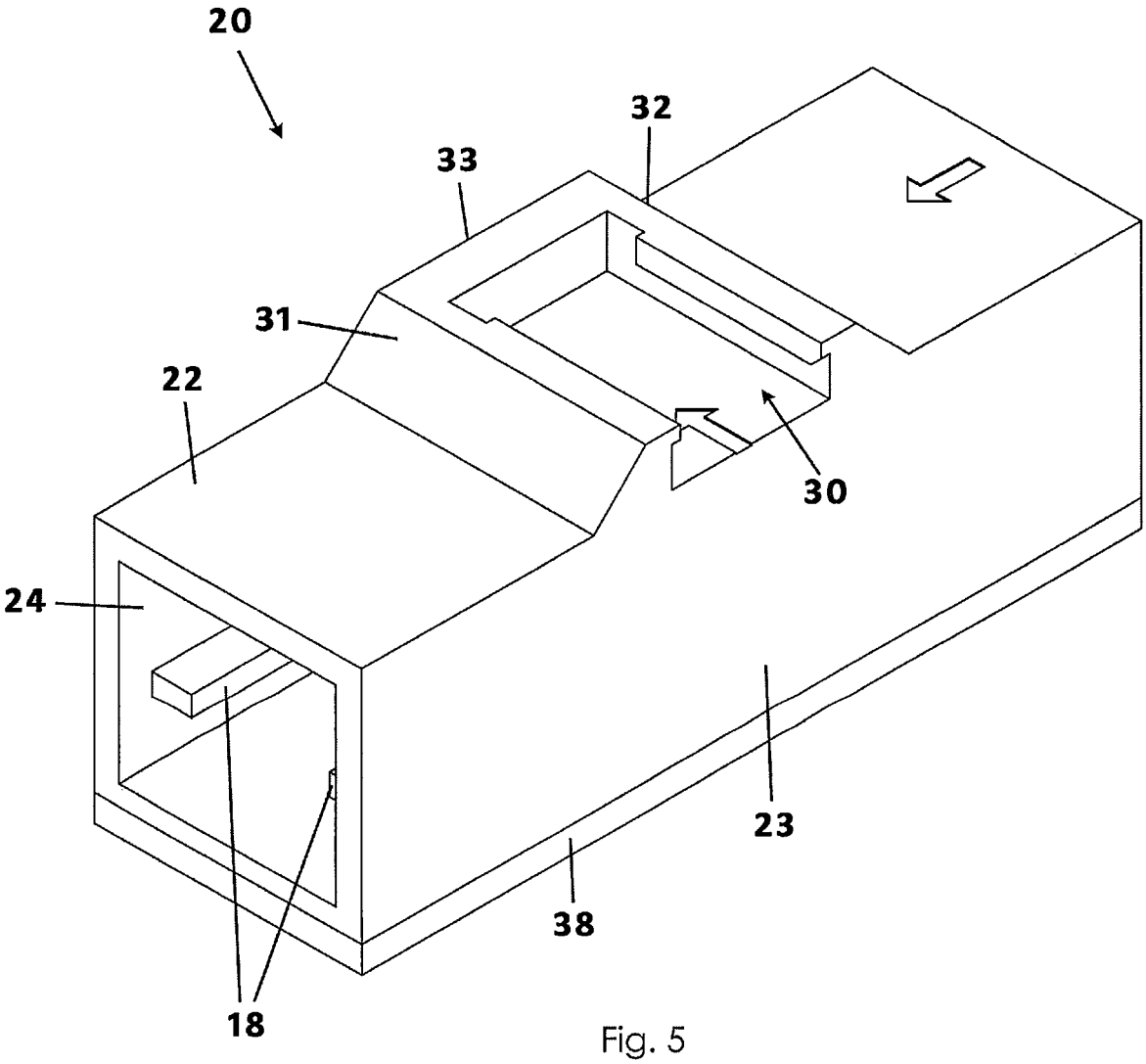
FIG. 5 is an isolated view on an enlarged scale of the first base member as in FIG. 3.
Figure 6:
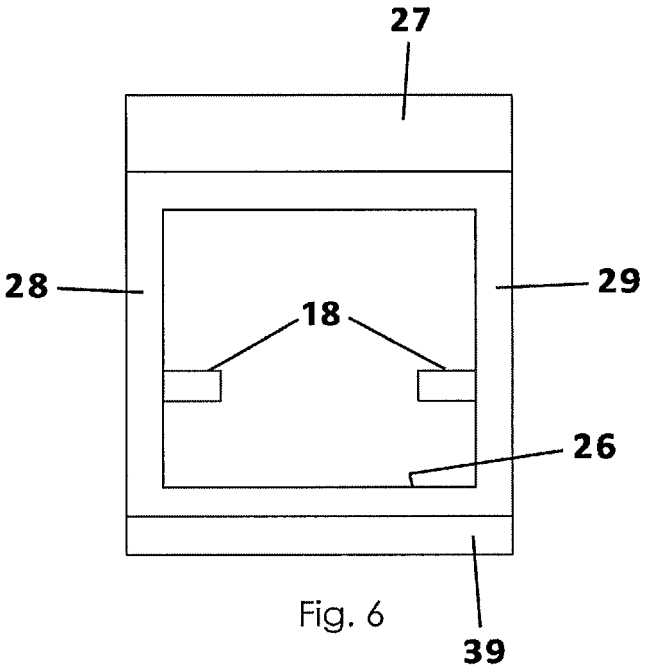
FIG. 6 is an end view of the second base member as in FIG. 2.
Figure 7:
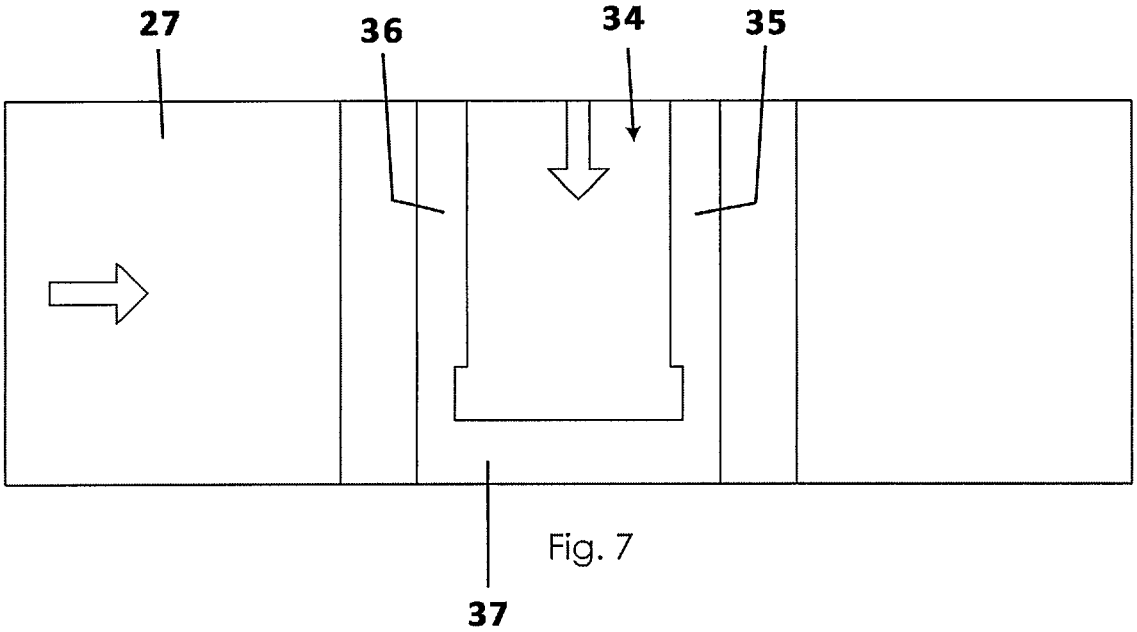
FIG. 7 is a top view of the second base member as in FIG. 2.

The bar member 40 includes a first end 41 and a second end 46 and has a linear and elongate configuration. Later, the first end 41 and second end 46 may be referred to as the bar first end and bar second end for clarity. Further, the bar member 40 includes a body section 39*a* extending between respective ends thereof and having a cylindrical or tubular configuration. The first and second ends of the bar member 40 include a first locking assembly 42 and a second locking assembly 47, respectively, that, in cooperation with the first and second nesting portions 30, 34, respectively, operate to allow respective bar member 40 ends to rest upon and engage the first nesting portion 30 and second nesting portion 34, respectively. First, the first locking assembly 42 includes a first flattened wall 43 (i.e. a planar wall and also referred to merely as a first flattened section). Further, the first locking assembly 42 includes a pair of side walls 44 (also referred to as opposed first side walls) adjacent and perpendicular to the first flattened wall 43. As shown in FIG. 4, a first side wall 44 is adjacent and below the first flattened wall 43. In an embodiment, the first locking assembly 42 may include a plurality of first nubs 45 spaced apart and mounted or integral along the edges of the first flattened wall 43, the first nubs 45 enhancing the friction and grip when the first flattened wall 43 is slidably moved into or upon the first nesting portion 30 and also when inserted into the first interior area as will be described later.

In a construction identical or substantially similar to the first locking assembly 42, the second locking assembly 47 includes a second flattened wall 48 (i.e. a planar wall and also referred to merely as a second flattened section). Further, the second locking assembly 47 includes a pair of second side walls 52 (also referred to as opposed second side walls) adjacent and perpendicular to the second flattened wall 48. In an embodiment, the second locking assembly 47 may include a plurality of second nubs 49 spaced apart and mounted or integral along the edges of the second flattened wall 48, the second nubs 49 enhancing the friction and grip when the second flattened wall 48 is slidably moved into or upon the second nesting portion 34 and also when inserted into the second interior area as will be described later.

Still further, the first end 41 of the bar member 40 includes a first rod section 50 coupled to or in singular construction with the first locking assembly 42 and having a hemispherical configuration (i.e. half of a rod or cylindrical configuration) Likewise, the second end 46 of the bar member 40 includes a second rod section 51 coupled to or in singular construction with the first locking assembly 42 and having a hemispherical configuration (i.e. half of a rod or cylindrical configuration).

It will be understood the open ends of the first base member 20 and the inner surfaces of the walls that form the rectangular or tube-shaped first base member 20 are configured so as to receive the first end of the bar member 40 into the first interior area. Likewise, the open ends of the second base member 25 and the inner surfaces of the walls that form the rectangular or tube-shaped second base member 25 are configured so as to receive the second end of the bar member 40 into the second interior area.

In another aspect, each base member includes a pair of oppositely disposed shelves mounted to inner surfaces of respective opposed side walls and are configured to engage respective offset or recessed side walls of a respective locking assembly of a respective end of the bar member 40 when the bar member 40 is inserted into a respective base member 20, 25. More particularly, the first base member 20 includes a pair of first shelves 18 mounted to inner surfaces of the first inside wall 23 and first outside wall 24, respectively, of the first base member 20, each shelf having a linear and elongate configuration and positioned to mate or nest with the pair of recessed side walls 44 of the first locking assembly 42 when the bar member 40 is inserted into the first interior area of the first base member 20. Likewise, the second base member 25 has a pair of second shelves which, while not shown specifically, have a construction that is identical to the pair of first shelves 18 shown and described herein. Therefore, The bar member 40 can be inserted and covered up for transportation. One half of the bar member 40 is housed in a first base member 20 and the other half will be housed in the second base member 25.

In an embodiment, the bar member is 1.5" in diameter with both ends having the opposite cutout as the top of the base members. This will allow the end of the bar to slide into a nesting portion on the top of a respective base member. This end has bumps or nubs within the end member to help give a pressure fit so as to keep the bar members from sliding freely out of a respective base member. With a base member 20, 25 attached to both ends of the bar member 40, it creates a parallette apparatus 10 which is used in many fitness exercises.

It is understood that while certain forms of this invention have been illustrated and described, it is not limited thereto except insofar as such limitations are included in the following claims and allowable functional equivalents thereof.

The invention claimed is:

1. A parallette apparatus, comprising:

a first base member having a first bottom wall and a first top wall opposite said first bottom wall and that includes a first inside wall and a first outside wall opposed to said first inside wall, said first inside wall and said first outside wall extending between said first top wall and said first bottom wall, respectively;

a second base member that includes a second bottom wall and a second top wall opposite said second bottom wall and that includes a second inside wall and a second outside wall opposed to the second inside wall, said second inside wall and said second outside wall extending between said second top wall and said second bottom wall, respectively; and a bar having a linear and elongate configuration and having a bar first end removably coupled to said first top wall and a bar second end removably coupled to said second top wall;

wherein:

said bar includes a body section displaced from said bar first end and displaced from said bar second end, said body section having a cylindrical shape configuration;

said first base member has a rectangular tubular configuration defining a first pair of open ends in communication with a first open interior area; and said second base member has a rectangular tubular configuration defining a second pair of open ends in communication with a second open interior area;

said first pair of open ends includes a first open end and a second open end configured to receive said bar first end into a first interior area defined by said first base member;

said second pair of open ends includes a third open end and a fourth open end configured to receive said bar second end into a second interior area defined by said second base member.

2. The parallette apparatus as in claim 1, wherein:

said first base member includes a first nesting portion situated atop said first top wall, said first nesting portion having a first upstanding side wall and a second upstanding side wall displaced from and parallel to said first upstanding side wall and an outer side wall extending between outer edges of said first upstanding side wall and said second upstanding side wall, respectively, of said first nesting portion;

inner edges of said first upstanding side wall and said second upstanding side wall define a void configured to receive said bar first end into said first nesting portion;

said second base member includes a second nesting portion situated atop said second top wall, said second nesting portion having a first upstanding side wall and a second upstanding side wall displaced from and parallel to said second upstanding side wall and an outer side wall extending between outer edges of said first upstanding side wall and said second upstanding side wall, respectively, of said second nesting portion; and inner edges of said first upstanding side wall and said second upstanding side wall, respectively, define a void configured to receive said bar second end into said second nesting portion.

3. The parallette apparatus as in claim 2, wherein:

said bar first end includes a first flattened section complementary to said first nesting portion of said first base member; and said bar second end includes a second flattened section complementary to said second nesting portion of said second base member.

4. The parallette apparatus as in claim 2, wherein:

said bar first end includes a first locking assembly having a first flattened wall and defining a pair of opposed first side walls adjacent and perpendicular to said first flattened wall, said pair of opposed first side walls being recessed relative to said first flattened wall; and said bar second end includes a second locking assembly having a second flattened wall and defining a pair of opposed second side walls adjacent and perpendicular to said second flattened wall, said pair of opposed second side walls being recessed relative to said second flattened wall.

5. The parallette apparatus as in claim 4, wherein:

said bar first end includes a first rod section coupled to said first locking assembly and having a hemispherical configuration;

said bar second end includes a second rod section coupled to said second locking assembly and having a hemispherical configuration.

6. The parallette apparatus as in claim 4, wherein:

said first base member includes a pair of first shelves mounted to inner surfaces of said first inside wall and said first outside wall of said first base member, respectively, said pair of first shelves each having a linear and elongate configuration for receiving said pair of first side walls of said first locking assembly, respectively;

said second base member includes a pair of second shelves mounted to inner surfaces of said second inside wall and said second outside wall of said second base member, respectively, said pair of second shelves each having a linear and elongate configuration for receiving said pair of second side walls of said second locking assembly, respectively.

7. The parallette apparatus as in claim 1, further comprising:

a first anti-slip layer coupled to a bottom surface of said first bottom wall, said first anti-slip layer resisting movement on a surface;

a second anti-slip layer coupled to a bottom surface of said second bottom wall, said second anti-slip layer resisting movement on a surface.

8. The parallette apparatus as in claim 3, wherein:

said first flattened section includes a first plurality of nubs;

an inner surface of said first bottom wall defines a plurality of first notches operable to receive said plurality of first nubs when said bar first end of said bar is inserted into said first interior area;

said second flattened section includes a second plurality of nubs;

an inner surface of said second bottom wall defines a plurality of second notches operable to receive said plurality of second nubs when said bar second end of said bar is inserted into said second interior area.

9. A parallette apparatus, comprising:

a first base member having a plurality of first walls that form a rectangular tubular configuration and that collectively define a first interior area;

a second base member having a plurality of second walls that form a rectangular tubular configuration and that collectively define a second interior area;

a bar having a linear and elongate configuration and having a bar first end removably coupled to a first top wall of said first base member and a bar second end removably coupled to a second top wall of said second base member;

wherein:

said bar includes a body section displaced from said bar first end and displaced from said bar second end, said body section having a cylindrical shape configuration;

said first base member has a first pair of open ends in communication with said first interior area; and said second base member has a second pair of open ends in communication with said second interior area;

said first pair of open ends includes a first open end and a second open end configured to receive said bar first end into said first interior area defined by said first base member;

said second pair of open ends includes a third open end and a fourth open end configured to receive said bar second end into said second interior area defined by said second base member.

10. The parallette apparatus as in claim 9, wherein:

said plurality of first walls includes a first bottom wall and said first top wall opposite said first bottom wall and that includes a first inside wall and a first outside wall opposed to said first inside wall, said first inside wall and said first outside wall extending between said first top wall and said first bottom wall, respectively;

said plurality of second walls includes a second bottom wall and said second top wall opposite said second bottom wall and that includes a second inside wall and a second outside wall opposed to the second inside wall, said second inside wall and said second outside wall extending between said second top wall and said second bottom wall, respectively.

11. The parallette apparatus as in claim 10, wherein:

said first base member includes a first nesting portion situated atop said first top wall, said first nesting portion having a first upstanding side wall and a second upstanding side wall displaced from and parallel to said first upstanding side wall and an outer side wall extending between outer edges of said first upstanding side wall and said second upstanding side wall, respectively, of said first nesting portion;

inner edges of said first upstanding side wall and said second upstanding side wall define a void configured to receive said bar first end into said first nesting portion;

said second base member includes a second nesting portion situated atop said second top wall, said second nesting portion having a first upstanding side wall and a second upstanding side wall displaced from and parallel to said first upstanding side wall and an outer side wall extending between outer edges of said first upstanding side wall and said second upstanding side wall, respectively, of said second nesting portion; and inner edges of said first upstanding side wall and said second upstanding side wall, respectively, define a void configured to receive said bar second end into said second nesting portion.

12. The parallette apparatus as in claim 11, wherein:

said bar first end includes a first flattened section complementary to said first nesting portion of said first base member; and said bar second end includes a second flattened section complementary to said second nesting portion of said second base portion.

13. The parallette apparatus as in claim 11, wherein:

said bar first end includes a first locking assembly having a first flattened wall and defining a pair of opposed first side walls adjacent and perpendicular to said first flattened wall, said pair of opposed first side walls being recessed relative to said first flattened wall; and said bar second end includes a second locking assembly having a second flattened wall and defining a pair of opposed second side walls adjacent and perpendicular to said second flattened wall, said pair of opposed second side walls being recessed relative to said second flattened wall.

14. The parallette apparatus as in claim 13, wherein:

said bar first end includes a first rod section coupled to said first locking assembly and having a hemispherical configuration;

said bar second end includes a second rod section coupled to said second locking assembly and having a hemispherical configuration.

15. The parallette apparatus as in claim 10, wherein:

said first base member includes a pair of first shelves mounted to inner surfaces of said first inside wall and said first outside wall of said first base member, respectively, said pair of first shelves each having a linear and elongate configuration for receiving said pair of first side walls of said first base member, respectively;

said second base member includes a pair of second shelves mounted to inner surfaces of said second inside wall and said second outside wall of said second base member, respectively, said pair of second shelves each having a linear and elongate configuration for receiving said pair of second side walls of said second base member, respectively.

16. The parallette apparatus as in claim 11, wherein:

said first flattened section includes a first plurality of nubs;

an inner surface of said first bottom wall defines a plurality of first notches operable to receive said plurality of first nubs when said bar first end of said bar is inserted into said first interior area;

said second flattened section includes a second plurality of nubs;

an inner surface of said second bottom wall defines a plurality of second notches operable to receive said plurality of second nubs when said bar second end of said bar is inserted into said second interior area.

* * * * *